US008967414B2

(12) United States Patent
Lane

(10) Patent No.: US 8,967,414 B2
(45) Date of Patent: Mar. 3, 2015

(54) BEVERAGE CONTAINER SYSTEM WITH LATCH TO MANAGE LID POSITION

(71) Applicant: Thermos L.L.C., Schaumburg, IL (US)

(72) Inventor: Marvin Lane, Wheeling, IL (US)

(73) Assignee: Thermos L.L.C., Schaumburg, IL (US)

( * ) Notice: Subject to any disclaimer, the term of this patent is extended or adjusted under 35 U.S.C. 154(b) by 0 days.

(21) Appl. No.: 14/105,479

(22) Filed: Dec. 13, 2013

(65) Prior Publication Data

US 2014/0166654 A1 Jun. 19, 2014

Related U.S. Application Data

(60) Provisional application No. 61/736,927, filed on Dec. 13, 2012.

(51) Int. Cl.

| | |
|---|---|
| ***A47G 19/22*** | (2006.01) |
| ***B65D 39/10*** | (2006.01) |
| ***B65D 45/16*** | (2006.01) |
| ***B65D 39/08*** | (2006.01) |

(52) U.S. Cl.

CPC ..... *A47G 19/2272* (2013.01); *B65D 39/08* (2013.01); *B65D 39/10* (2013.01); *B65D 45/16* (2013.01); *B65D 39/082* (2013.01); *B65D 2251/1033* (2013.01)

USPC ..... 220/284; 220/713; 220/326; 220/301

(58) Field of Classification Search

CPC ..... B65D 39/02; B65D 39/10; B65D 39/08; B65D 39/082; B65D 45/16; B65D 2543/00092; B65D 2543/00074; B65D 2543/00064; B65D 2251/1033; B65D 2251/1016

USPC ..... 220/284, 260, 326, 324, 315, 300, 301, 220/296, 288, 713, 711, 756; 222/470, 568, 222/567, 566

See application file for complete search history.

(56) References Cited

U.S. PATENT DOCUMENTS

| | | | | |
|---|---|---|---|---|
| 4,051,984 | A * | 10/1977 | Ho | 222/471 |
| 4,750,644 | A * | 6/1988 | Kolody | 222/144.5 |
| 5,307,950 | A * | 5/1994 | Li | 220/714 |

* cited by examiner

*Primary Examiner* — Robert J Hicks
(74) *Attorney, Agent, or Firm* — Polsinelli PC

(57) ABSTRACT

A drinking mug includes a lid affixed at the mouth of the mug. The lid includes fluid openings between a bottom portion of the lid and sidewalls of the lid about the circumference of the lid to permit drinking from any position along the circumference. The lid has a gasket that seals the mug closed when the lid is threaded to a closed position. When the lid is partially unscrewed, the gasket opens, permitting liquid to be consumed from the beverage container through the fluid openings in the lid. The lid includes a ramp-shaped cam and the mug includes a pivotable latch that engages the cam that prevents the lid from being unscrewed from the mug. The latch has a push button that releases the latch from the cam to permit removal of the lid.

12 Claims, 8 Drawing Sheets

BEVERAGE CONTAINER SYSTEM WITH LATCH TO MANAGE LID POSITION

CROSS REFERENCE TO RELATED APPLICATION

This application claims the benefit of U.S. Provisional Patent Application Ser. No. 61/736,927, filed Dec. 13, 2012, which is incorporated herein by reference.

FIELD

Beverage containers are generally disclosed herein, including a beverage container that has a mug or cup with a detachable lid having a drinking opening through which a beverage may be consumed without removing the lid from the mug or cup.

BACKGROUND

Many beverages containers, such as coffee carafes and travel mugs, have a lid that attaches to the container body to prevent spilling of the beverage during transport. The lid of one type of such beverage container attaches by mating threads on the lid to complementary threads in the neck of the container and screwing the lid into or onto the container. A gasket, or some other similar seal, is typically disposed between an interior beverage-holding portion of the container and the lid to prevent the beverage contained therein from leaking out of the container while the lid is engaged in a closed position.

To dispense the beverage from this type of container, the lid of the container may be partially unscrewed to either unseat or relocate the position of the gasket or seal within the container and permit the beverage to flow out of the container through an opening while still retaining the lid on the container. This configuration permits the user to either sip or pour the beverage from the container without entirely removing the lid from the container. However, a downside of this type of container is that the user may inadvertently unscrew the lid further than is necessary to merely dispense a beverage, thereby resulting in the lid coming loose from the container. More specifically, when unscrewing the lid to move the lid from the sealed position to a position that will permit fluid flow through the lid while the lid is still partially engaged with the container, the user may inadvertently unscrew the lid so that the threads of the lid are no longer engaged with the threads of the container. When this occurs, the lid may fall off of the top of the container when the user tries to sip or pour the beverage and possibly spill the beverage.

Some containers have attempted to address this problem by including a small protrusion on one of the threads of the lid that is supposed to cause a small interference fit with a similar protrusion on the complementary threads of the container body. However, this solution has some drawbacks. First, this interference fit is often times not very pronounced and can be easily overcome by the user without the user even noticing they have unscrewed the cap past the engagement of the interference fit, which may result in the user unscrewing the lid too far. Second, the protrusion on the threads can wear down over time and be less effective at indicating to the user that the lid is in the open position. Both of these drawbacks can also lead to a user inadvertently unscrewing the lid past the interference point so that the lid falls off during use.

Accordingly, there is a need for a beverage container system configured to permit locking a lid onto a container in an open condition in which the contents of the container may be dispensed and, accordingly, prevent the lid from being inadvertently disengaged completely from the container.

DETAILED DESCRIPTION

While the present invention is includes many various forms, the description below of several embodiments is made with the understanding that the present disclosure is to be considered as an exemplification of the claimed subject matter, and is not intended to limit the appended claims to the specific embodiments illustrated. The headings used throughout this disclosure are provided for convenience only and are not to be construed to limit the claims in any way. Embodiments illustrated under any heading may be combined with embodiments illustrated under any other heading.

The subject matter is sufficiently specific to meet statutory requirements. The inventors have contemplated that the claimed subject matter may also take the form of various alternate embodiments, to include different steps or combinations of steps similar to those described herein, in conjunction with other present or future technologies.

Certain embodiments described herein is a beverage container system, where the lid includes one or more beverage dispensing openings and the beverage container includes a latch disposed between the body of the container and the lid to prevent unscrewing of the lid beyond a predetermined position, the predetermined position being reached before the lid is able to be released from the mug, and thereby preventing complete removal of the lid from the container without first actuating a latch.

Figure 1:
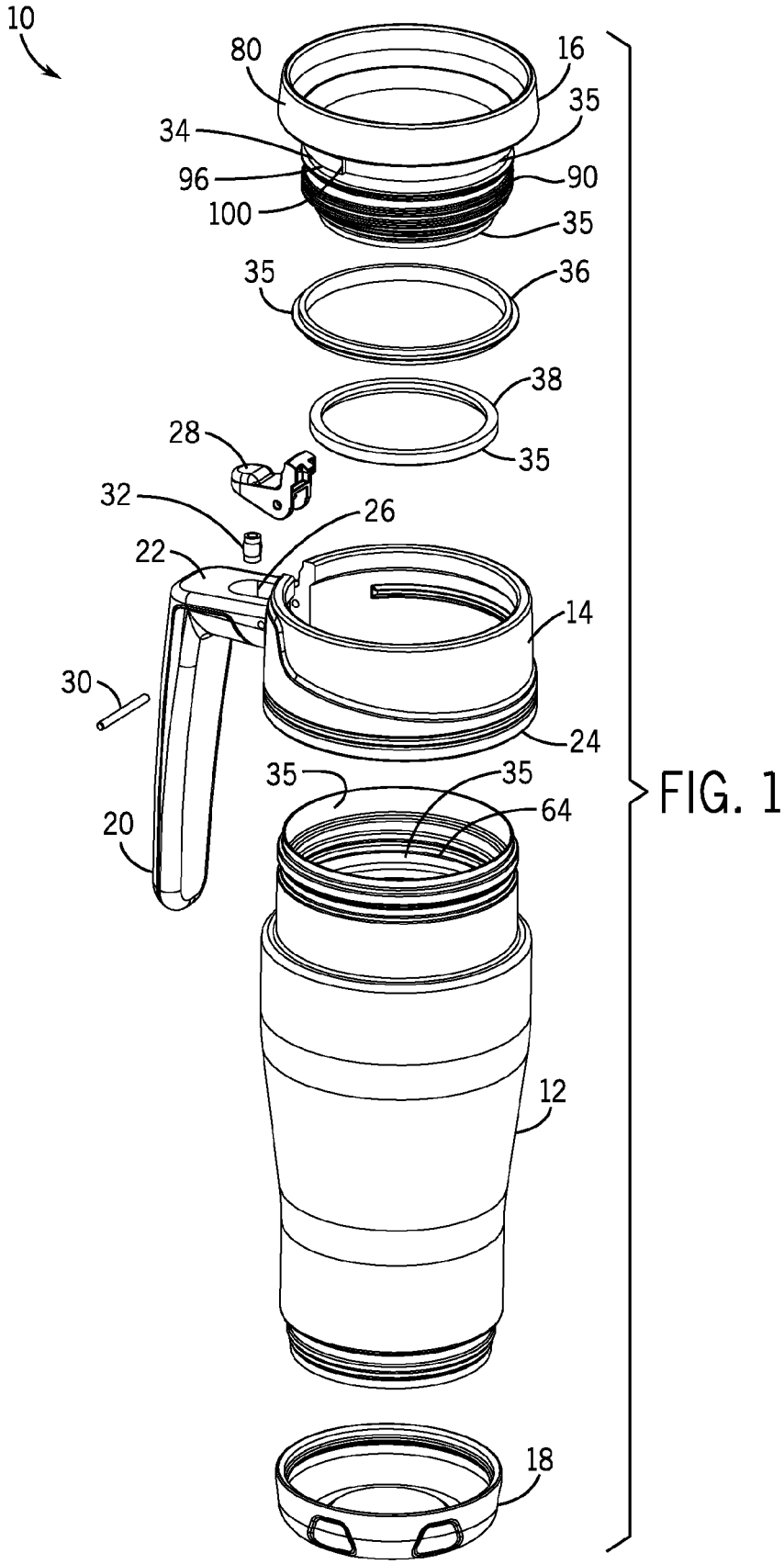
FIG. 1 is a perspective exploded view of an embodiment of a beverage container system having a latch to manage lid position, as disclosed herein.

Referring to FIG. 1, a beverage container system 10 is disclosed in an unassembled, exploded view condition. The beverage container system 10 includes a container body 12, a handle body 14 connected to the upper end of the container body 12, and a lid body 16 to be selectively secured to the upper end of the container body 12. The beverage container system 10 may also include an optional container base 18. For purposes of this application, the term "container body" includes any component that has the ability to store, hold, or dispense any liquid. For purposes of this application, the container body may include both the container body and the handle body, which may be referred to as a container portion and a handle portion.

The embodiment of a handle body 14 illustrated in FIG. 1 is formed in a separate piece from the container body 12, however, in other embodiments, the handle assembly and container body are formed of one piece. The handle body 14 has a grip portion 20, a connector portion 22, and a collar 24. The connector portion 22 is configured to be attached to the collar 24. The collar 24 is configured to meet with a portion of the container body 12. The connector portion 22 may include a recess 26 configured to receive a lid release button 28. The lid release button 28 is coupled to the connector portion 22 by a hinge pin 30 and is biased to an engaged position by a spring 32 or other biasing member. The lid release button 28 engages a latch 34 on the lid body 16, as will be described in more detail hereinafter.

As illustrated in FIG. 1, certain embodiments of a beverage container system 10 also include one, two, or more sealing surfaces 35. Each sealing surface 35 has a complementary sealing surface against which it may be pressed to form a seal. A sealing surface 35 may be a gasket or another type of surface configured to form a liquid-tight seal. A complementary sealing surface may include a wall or other surface. In the illustrated embodiment, a lower gasket 38 may be positioned to prevent liquid from leaking out of the fluid flow openings 46 when the lid is in a closed position. An upper gasket 36 may be positioned to prevent liquid from leaking out from between the lid body 16 and the handle body 14 when the lid assembly is in the closed position or the open position. When the lid assembly is moved to an open position, the upper gasket 36 maintains a fluid seal but the lower gasket 38 is spaced from its sealing surface to provide a gap through which the fluid may flow from the interior of the beverage container system 10. When the lid assembly is moved to a removed position, the lid assembly is not in contact with the container body.

Also, in certain embodiments, one or more gaskets may be positioned to prevent liquid from leaking out between the handle body 14 and container body 12 or the lid body 14 and container body 12.

Figure 2:
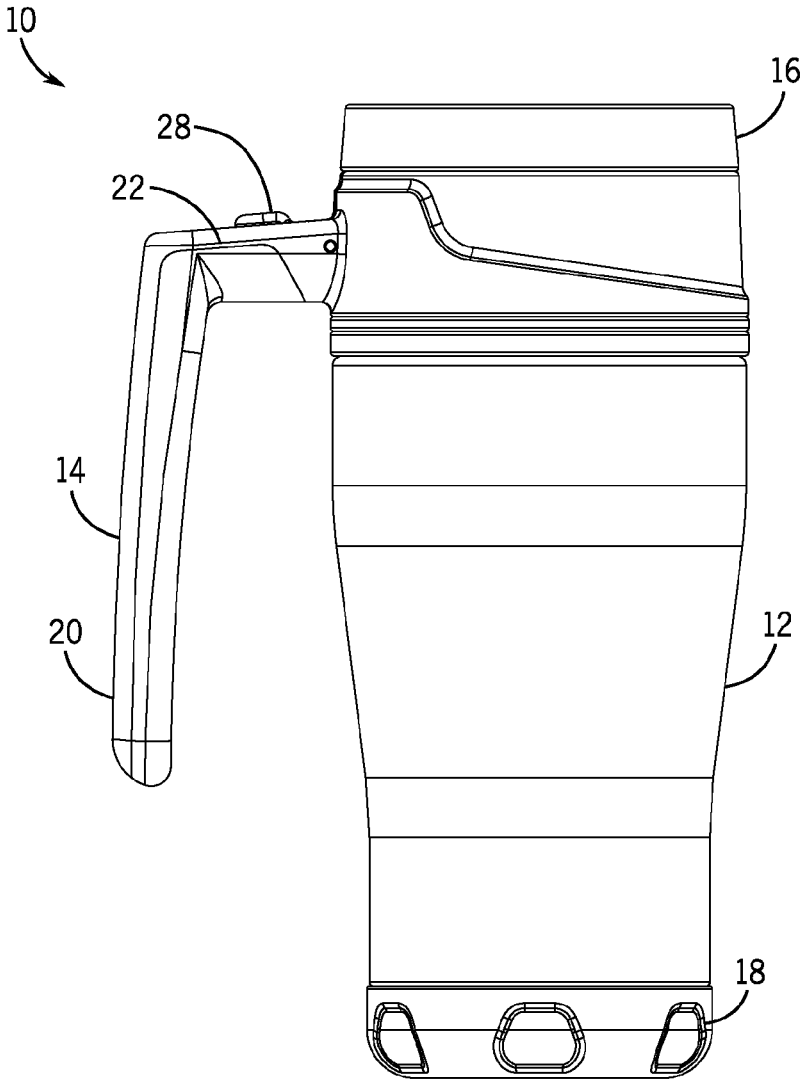
FIG. 2 is a side view of an embodiment of the beverage container of FIG. 1.

Referring to FIG. 2, an embodiment of the beverage container system 10 disclosed herein is shown in its assembled state, in a side view, showing an optional container base 18 attached to the lower end of the container body 12, the handle body 14 attached to the upper end of the container body 12, and the lid body 16 mated with the upper end of the container body 12 and handle body 14. The lid release button 28 for the latch is visible extending upward from the connector portion 22 of the handle body 14. The beverage container system 10 may be configured such that a user holding the travel mug by the grip portion 20 of the handle body 14 may easily reach the lid release button 28 with a finger or thumb to release the lid body 16 from a latched position.

Figure 3:
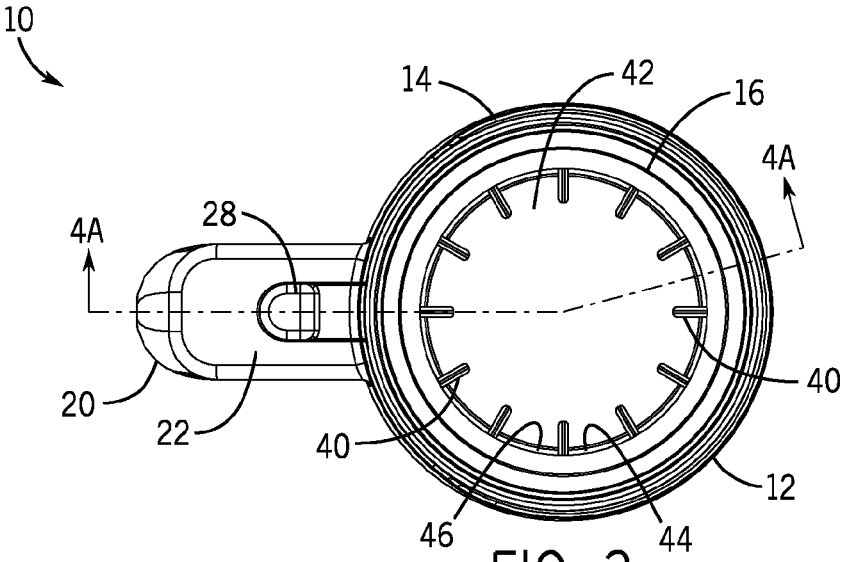
FIG. 3 is a top view of an embodiment of the beverage container of FIG. 1.

Referring to FIG. 3, an embodiment of the beverage container system 10 disclosed herein is shown in its assembled state, in a top down view, showing the lid body 16 in a mated condition with the handle body 14 and container body 12, and indicating the section cut line for the side section views shown in FIGS. 4-5. The lid release button 28 in the connector portion 22 of the handle body 14 is centered in the handle body 14.

While certain embodiments of a beverage container system 10 may include a lid body 16 having a drink aperture such as a spout, straw, or a generally round or mouth-shaped orifice, certain other embodiments have a liquid release element formed by a gap between a bottom surface 42 and a sidewall 44. The bottom surface 42 and sidewall 44 may be connected by one or more radial ribs 40. When the lid assembly is in the open position, the gap between the bottom surface 42 and the sidewall 44 forms a series of one or more fluid flow openings 46. Each fluid flow opening 46 is defined by a first radial rib 40, an edge portion of the bottom surface 42, a second radial rib 40, and a border section of the sidewall 44. The series of fluid flow openings 46 may be continuous generally around the entire circumference of the lid body 16 or may include only one or more fluid flow openings 46. In certain embodiments, fluid flow openings 46 permit the user to drink from the beverage container system 10 from any position about the circumference of the lid body 16, rather than being limited to drinking from a small orifice at one position along the circumference as with many beverage cups.

Figure 4A:
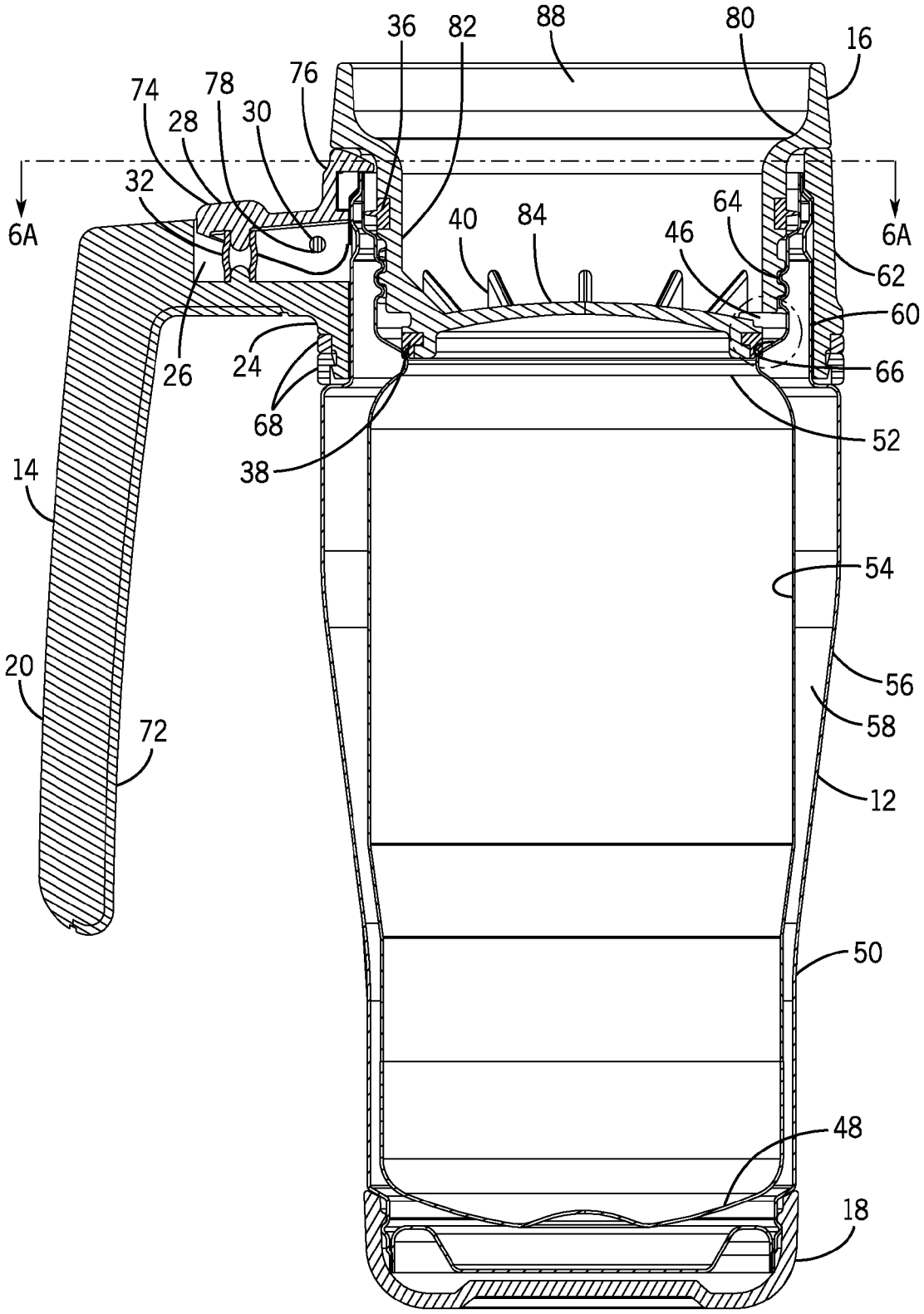
FIG. 4A is a side cross-sectional view of an embodiment of the beverage container system of FIG. 1 taken about section line D-D in FIG. 3, showing the lid release button and locking tab in a locking position, fluid flow openings in the lid, and the lid positioned in a closed position.

Referring to FIG. 4A, in certain embodiments of the disclosure herein, the container body 12 of the beverage container system 10 generally takes the shape of a cup having a closed container bottom 48, closed container sidewall 50 extending upward therefrom, and an open container mouth 52 disposed at an upper end of the container body 12 and formed by the sidewalls 50. The one or more sidewalls 50 may include a generally cylindrical interior wall. The container body 12 preferably has a circular cylindrical shape, and may be made from stainless steel. However, the disclosure of the illustrated embodiment should not be read to limit the shape of the container body to circular cylindrical shape or made from stainless steel. In alternate embodiments, the container body may take alternate shapes, such as a square cylindrical shape, other cylindrical shapes, or other shapes that are capable of storing a liquid beverage. In addition, in alternate embodiments, the outer container may be made of aluminum, or other metallic or polymeric materials, or other materials without departing from the scope of the present disclosure.

Referring further to FIG. 4A, in certain embodiments, the container body 12 has an inner shell 54 and an outer shell 56 that define an insulating chamber 58 there between. In this manner, the container body 12 is a double-walled insulated container. The inner and outer shells 54 and 56 each have a closed shell bottom closed shell sidewall, and an open upper shell edge. In certain embodiments, the double-walled insulated container body 12 may be formed by seating a generally cup-shaped inner shell 54 inside of a generally cup-shaped outer shell 56, which outer shell 56 is larger than the inner shell 54. The shells 54 and 56 are sealingly connected to each other at their open upper ends such that no gas may thereafter enter into or escape from the space inside the chamber 58. Any air or other gas may be evacuated from or pumped out of the chamber 58 prior to sealing the two shells 54 and 56 together, thereby creating a container body 12 that is a double-walled and vacuum insulated, which likely will maintain contents of the container body at a relatively constant temperature over a period of time.

The inner and outer shells 54 and 56 are both preferably made from stainless steel, aluminum, or another material of suitable rigidity sufficient to resist deforming under the forces placed on the sidewalls by the negative pressures of the vacuum within the chamber. In alternate embodiments, the inner and outer shells may be sized such that only the sidewalls, and not the bottom, or only a portion of the sidewalls of the container body are double-walled vacuum insulated walls, without departing from the scope of the present disclosure. The insulating chamber 58 between the inner and outer shells of the double-walled container body may contain a vacuum, a partial vacuum, air, inert gas or a combination of gasses, an insulation material, or may otherwise be insulated with still further alternative materials. In certain embodiments, the container body may be draw formed from a single sheet of stainless steel without the need to attach separate components thereto by other processes or subsequent steps. Alternatively, each of the inner shell, outer shell, and even the bottoms of the container base may be draw formed as separate components and welded or otherwise sealingly joined together to form the container body 12.

Referring further to FIGS. 1 and 4A, in certain embodiments, the container body 12 optionally has a container base 18 affixed to its lower end. The container base 18 may provide some alternative configuration or feature not present in the closed container bottom 48. For example, a container base 18 may provide the container body 12 with a more stable base upon which it may rest on a table or other flat or non-flat surface. In certain embodiments, the container base 18 may be made of plastic and have the shape of a shallow cup that is snapped or otherwise fastened over at least some portion of the closed container bottom 48. In other embodiments, the container base 18 may be made of rubber, rubberized plastic, rubberized metal, or other such materials that may provide the container body 12 with a non-slip or treaded surface at its bottom end. In still further alternate embodiments, the container base 18 may have a tread pattern imprinted in or on an outer surface thereof to provide further non-slip functionality to the container body 12. The container base 18 may also include one or more strengthening ribs or webs projecting from an interior surface thereof. The strengthening ribs provide structural strength to the container base 18 and may rest against or near a bottom surface of the closed container bottom of the container body. In certain embodiments the container base 18 may be removable so as to facilitate easy cleaning of the container body 12. Alternatively, the container base 18 may be affixed to the container body 12 such that the container base 18 and the container body 12 are configured to be difficult to separate. In certain embodiments, the container base 18 is affixed to the container body 12 by pressing the container base 18 onto the bottom of the container body 12 with a pneumatic press. An inwardly projecting ridge can be seen in FIG. 4A about the inside of the container base 18 to provide engagement between the container body 12 and the container base 18.

In certain embodiments, the container body 12 includes a recessed groove 60 disposed in the sidewall of the outer shell 56. The recessed groove 60 may be located near the mouth of the container body 12 and may be a continuous groove that extends around the full exterior circumference of the outer shell 56 of the container body 12. This recessed groove 60 is for engaging with one or more locking lugs 62 protruding from the handle body 14, to affix the handle body 14 to the container body 12, as will be explained in detail further below.

In certain embodiments, the cylindrical sidewall of the container body 12 also defines a neck 64 disposed adjacent to the mouth of the container body 12. In certain embodiments, the neck 64 includes one or more thread structures formed therein that are used to mate with one or more complimentary thread structures located on the lid body 16 of the beverage container system 10, to fasten the lid body 16 to the container body 12. However, the disclosure of thread structures should not be read to limit the structures that are used to fasten the lid body 16 to the mouth of the container body 12. In alternate embodiments, the neck may include bayonet mounting features that mate with complimentary bayonet mounting structures located on the lid body of the beverage container, or otherwise use additional fastening or mating structures and methods, without departing from the scope of the disclosure herein. In still alternate embodiments, the neck 64 may not contain any rotational fastening structures, and only be configured for the lid body 16 to be mated to the container body 12 by pressing the lid body 16 into the mouth of the container body 12, similar to a cork or stopper in a bottle.

Figure 4B:
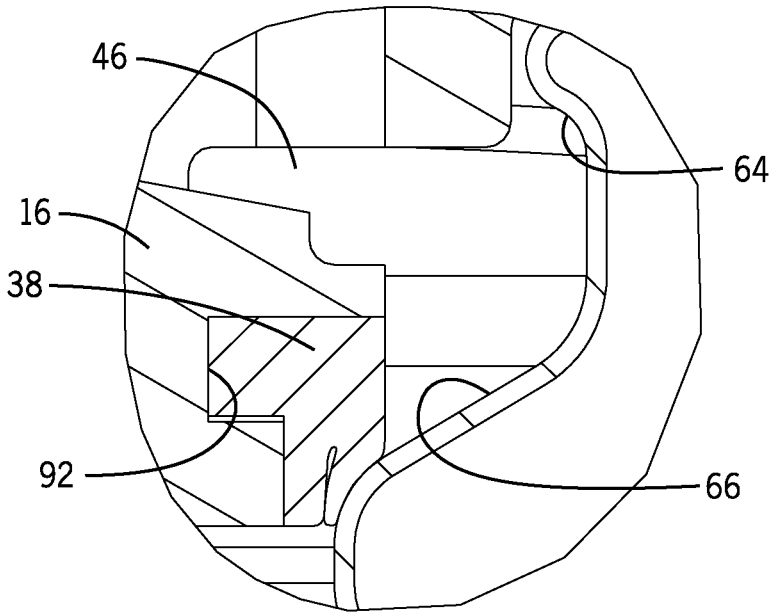
FIG. 4B is a detail view of an aspect of an embodiment of the beverage container system shown in the cross-sectional view of FIG. 4A, showing one of the fluid flow openings through the lid.

Furthermore, in certain embodiments, the container body 12 includes a circumferential sealing ridge 66 formed in the inner shell 54 of the container body 12 between the beverage holding portion of the inner shell 54 and the thread structures located in the neck 64. The sealing ridge 66 is a continuous circumferential ridge that protrudes radially inward and otherwise reduces the diameter of the sidewall of the inner shell 54 as compared to the diameter of the neck portion of the container body 12. Referring to FIG. 4B, the sealing ridge 66 provides a rigid sealing surface against which a lower gasket 38 in the lid body 16 forms a liquid tight seal, in order to seal the container body 12 closed when the lid body 16 is mated to the container body 12 and moved to a closed position.

Referring again to FIGS. 1 and 4A, a handle body 14 is affixed to the container body 12. The handle body 14 includes a handle or grip portion 20, a lid release button 28, a pin 30 to hingeably affix the lid release button 28 within the handle body 14, a spring 32 to hingeably bias the lid release button 28 to a locking or latched position, and one or more optional decorative rings 68 affixed to the handle body. In certain embodiments, the handle body 14 itself includes a cylindrical collar 24 for mating the handle body 14 to the upper end of the container body 12, and one or more locking lugs 62 protruding from an inner surface of the collar 24. The grip portion 20—which is generally L-shaped in the illustrated embodiment—may extend downward from the collar 24 of the handle body 14 to provide a grip for a user to hold the beverage container system 10, and the release button recess 26 disposed in portions of both the handle body 14 and the collar 24. In certain embodiments, the collar 24 is generally cylindrical in shape with an open top end and an open bottom end forming a ring. The handle body 14 is affixed to the upper end of the container body 12 by sliding the bottom end of the collar 24 over the mouth of the container body 12 and pressing the handle body 14 onto the container body 12 until the locking lugs 62 protruding from the interior surface of the collar 24 are seated into the recessed groove 60 disposed in the upper end of the container body 12. In this manner, the handle body 14 is not configured to be removable from the container body 12. In certain embodiments, three separate locking lugs 62 protrude from the interior surface of the collar 24 of the handle body 14. However, in alternate embodiments, differing numbers of locking lugs may be employed without departing from the scope of the present disclosure. In certain embodiments, the handle body 14 is injection molded from a heat resistant polymeric material that can withstand high temperatures without deforming, softening, or heating up. However, in alternate embodiments, the handle body 14 can be made from other polymeric materials with different physical properties and behaviors as needed or desired. In the illustration of FIG. 4A, the grip portion 20 includes a grip enhancing material 72 on an inside surface.

In certain embodiments, the lid release button 28 is generally "L" shaped and has a push button 74 disposed at the end of a first leg of the "L," a locking tab 76 disposed at the end of the second leg of the "L," and a pivot hole 78 located near the intersection of the two legs of the "L" and configured to accept a hinge pin 30. The lid release button 28 may be inserted into the release button recess 26 disposed in the handle body 14 and the hinge pin 30 may be inserted through both a hole in the handle body 14 and the pivot hole 78 in the lid release button 28. These steps pivotally lock the lid release button 28 into the handle body 14. Before the lid release button 28 is affixed to the handle body 14 by the hinge pin 30, a spring 32 may be loaded between the underside of the push button 74 and the bottom of the release button recess 26. The spring 32 applies an upward force on the underside of the lid release button 28 so that the lid release button 28 will be pivotally biased to an upward position and the locking tab 76 will be biased toward the axial center of the container body 12 to a locking position. In certain embodiments, the spring 32 is a rubber tube spring that is compressed longitudinally about the central axis of the tube spring when the push button 74 is depressed by the thumb or finger of a user so as to move the lid release button 28 to an unlocked position wherein the locking tab 76 is moved to a position where it engage the cam during unthreading movement of the lid. When the push button 74 is released, the force of the compressed rubber tube spring 32 on the underside of the lid release button 28 causes the lid release button 28 to pivot back to its upper locking position and the locking tab 76 to pivot to its forward locking position toward the center of the container body 12.

Referring to FIG. 4A, in addition, the handle body 14 may include one or more decorative rings 68 affixed to a lower end of the handle body about the outer circumference of the handle body 14. The one or more decorative rings 68 may close off any space between the handle body 14 and an outer surface of the container body 12 at the recessed groove 60. The one or more rings 68 are preferably made from polypropylene, or any other suitable polymeric, metallic, or other material as desired. The one or more rings 68 may be a single color or multiple colors as desired. In certain embodiments, the one or more rings 68 may be affixed to the handle body 14 by three large lugs protruding from the rings 68 that mate with a complimentary recess in the handle body 14 at the location of the lugs to create a snap-fit engagement configured to be sustainable for a long period of time. In alternate embodiments, the decorative rings 68 may be affixed by adhesive, sonic welding, or other known affixing methods.

Referring to FIGS. 1 and 4A-7, the lid body 16 of the beverage container system 10 is a 360-degree drink-through lid, whereby when the lid assembly is moved to an open position within the container body 12 (see FIGS. 5A and 5B), fluid can exit from within the beverage container system 10 (as indicated by the broken line arrows) by passing through one or more of the openings in the lid body 16 that are located 360-degrees around the lower perimeter of the lid body 16, permitting a user to drink from any side of the beverage container the user chooses. Such a lid body 16 with openings located 360-degrees or at least two areas around the lid body 16 also provides venting for the beverage container system 10 to allow smooth or laminar fluid flow from within the container. As will be described in greater detail, the user may only dispense fluid from the container when the lid is in the opening or liquid dispensing position, whereas preferably the fluid is prevented from being dispensed when the lid is in a sealed position.

A lid assembly 80 includes a lid body 16. a lower gasket 38 affixed to a bottom end of the lid body, and an upper gasket 36 disposed about an outer surface of the lid body 16. In general, the lid body 16 is generally cup shaped. The lid body 16 has substantially closed cylindrical lid sidewall 82, a substantially closed lid bottom surface 84, a plurality of fluid flow openings 46 in one or more of the bottom surface and sidewall of the lid body, which as disclosed above may be disposed 360-degrees around the periphery of the lid body, and an open top end 88 from which beverages may be sipped or poured when the lid assembly 80 is in an open position. The bottom surface 84 of the lid is spaced from the lid sidewall 82 to define the fluid flow openings 46 between the surface 84 and the sidewalls 82. The bottom surface 84 and the sidewalls 82 are connected to one another by the radial ribs 40, between which is provided the fluid flow openings 46. As a result, fluid may flow from the interior of the container, through the fluid flow opening 46 between the bottom surface 84 and sidewall 82 of the lid body 16 and through the openings 46 between the ribs 40.

As previously discussed, in certain embodiments, the lid body 16 further includes one or more thread structures 90 to engage with the thread structures disposed in the neck 64 of the container body 12. The thread structures 90 of the lid body 16 are disposed in or on an outer surface thereof. In certain embodiments, a lower gasket 38 is seated in, and/or protrudes from, a recess 92 disposed in a lower outside portion of the lid body 16. Referring to FIGS. 4A and 4B, when the lid body 16 is secured to the container body 12 and tightened to a closed position by threading the lid inward, the lower gasket 38 on the lid body 16 is compressed between the lid body 16 and the sealing ridge 66 in the container body 12 to provide a liquid tight seal there between. This liquid tight seal prevents or at least minimizes any fluids from leaking out of the interior space of the beverage container system 10 when the lid body 16 is in the closed position. Unthreading the lid moves the lower gasket 38 away from the sealing ridge 66 to move the lid to the open position, which permits fluids in the container to be dispensed.

In certain embodiments, the upper gasket 36 is seated in a circumferential recess 94 disposed in an upper outside portion of the lid body 16 and engages an interior cylindrical wall within the container body 12. The upper gasket 36 maintains a sealed condition between the lid body 16 and the container body 12 when the lid is in both the closed position and when the lid is in the open, liquid dispensing position. The purpose of the upper gasket 36 is to prevent or at least minimize fluid from leaking out of or escaping from the beverage container system 10 while fluid is being sipped or poured through the lid body 16. The lid body 16 is configured to mate inside of the neck 64 of the container body 12. However, in alternate embodiments, it is contemplated that the lid body 16 may secure over the outside of the neck of the container body, without departing from the scope of the present disclosure. In certain embodiments, an example of which is shown in FIG. 5C, the upper gasket 36 has at least one fin 65 protruding radially outward therefrom and into contact with the cylindrical interior surface 67 of the container body to provide a liquid tight seal between the lid body 16 and the inner wall 54 of the container body 12, even when the lid body 16 is only partially mated or engaged with the container body 12 and is otherwise located in an open, liquid dispensing position.

Figure 5A:
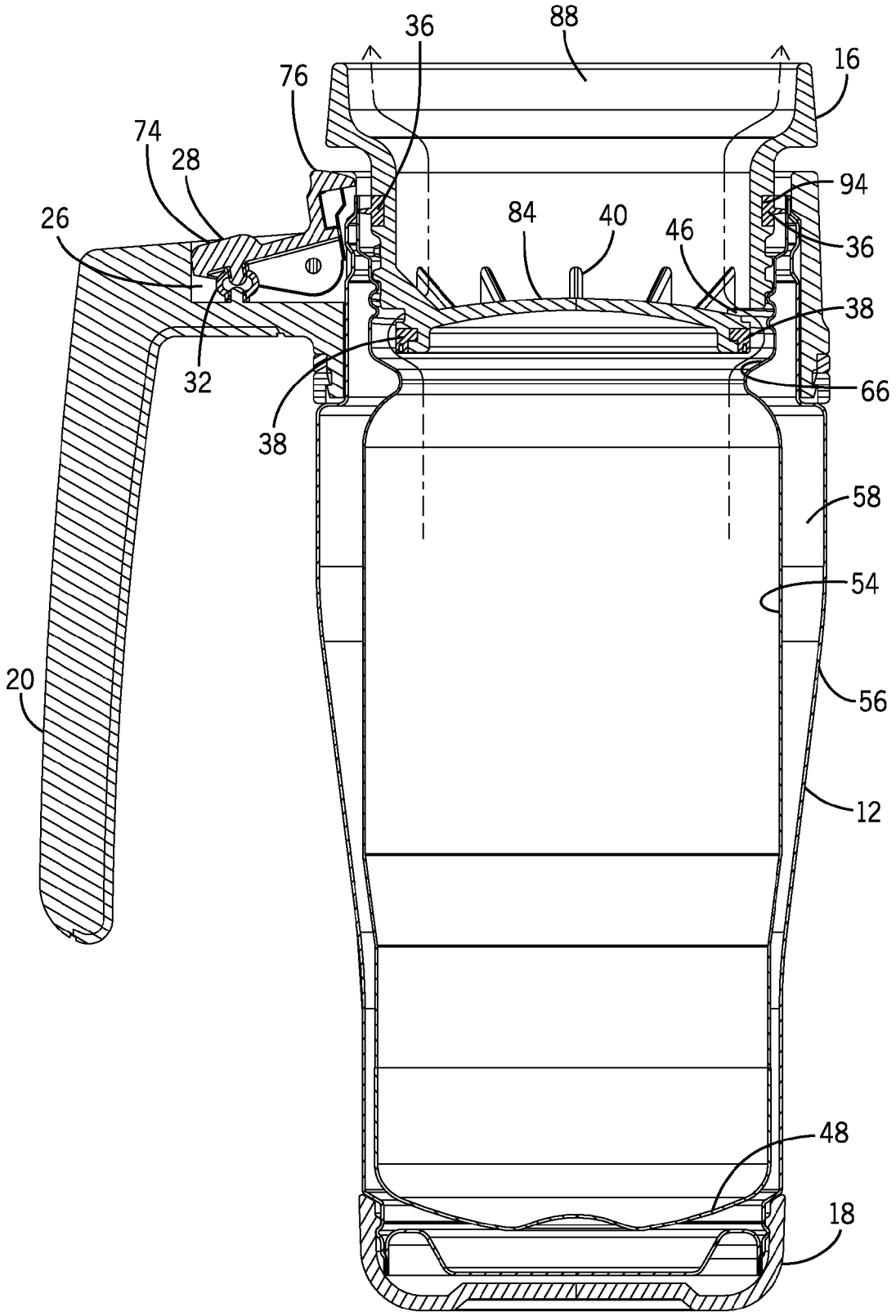
FIG. 5A is a side cross-sectional view of an embodiment of the beverage container system of FIG. 1 taken about section line D-D in FIG. 1, showing the lid release button in a depressed state and the locking tab pivoted to an unlocked position, the lid partially unscrewed to an open position with the lower gasket moved to a disengaged position so as to permit fluid to flow from inside the beverage container system and through the fluid flow openings of the lid to be consumed by a user.
Figure 5B:
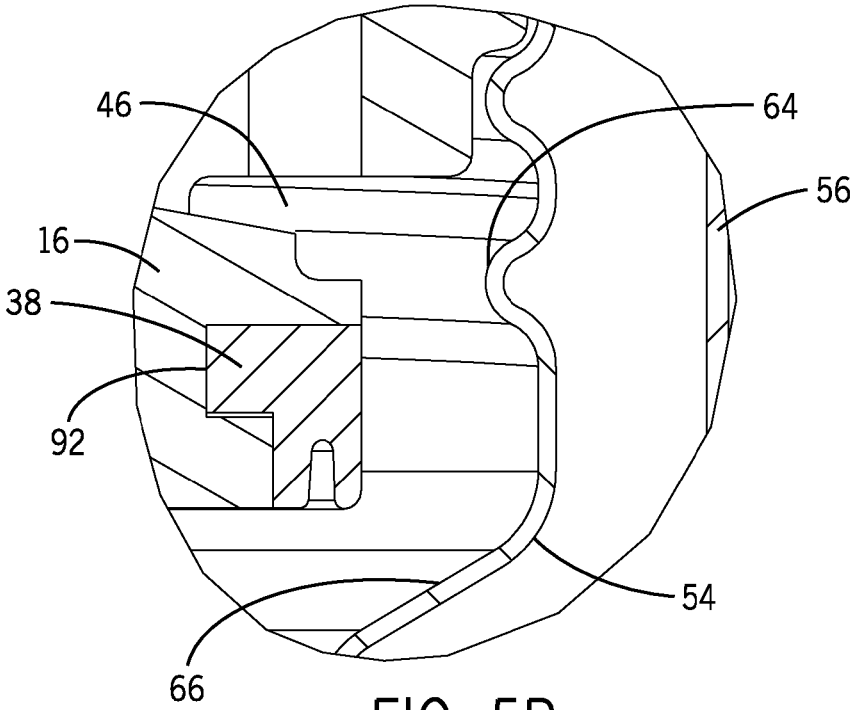
FIG. 5B is a detail view of an aspect of an embodiment of the beverage container system shown in the cross-sectional view of FIG. 5A, showing the lower gasket moved to a disengaged position when the lid is partially unscrewed to an open position, and showing one of the fluid flow openings through the lid, which is open and accessible for fluid to pass therethrough.
Figure 5C:
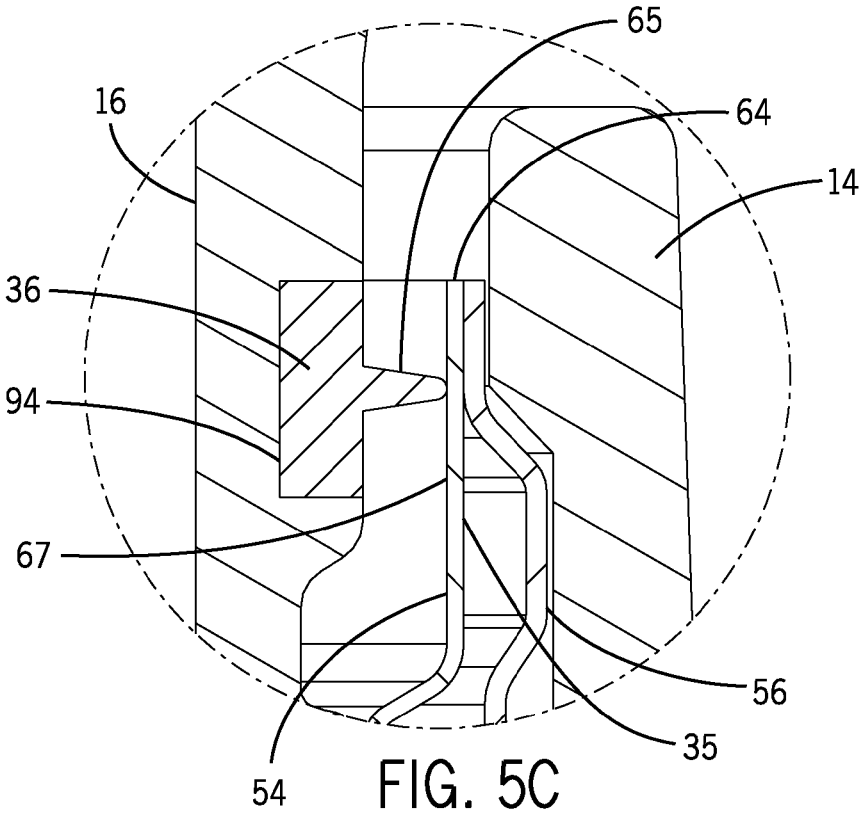
FIG. 5C is an enlarged cross sectional view of the upper gasket in the lid in sealing engagement with the interior of the neck of the beverage container.

Referring to FIGS. 5A and 5B, for the purposes of this disclosure, the open position of the lid assembly 80 is any position in which the lower gasket 38 is not compressed against the sealing ridge 66 to prevent or at least minimize the amount of fluid exiting the container body 12. Thus, this open position of the lid assembly 80 includes any positioning of components in which fluid inside the container body 12 is permitted to flow past the lower gasket 38 and exit the container body 12 through the fluid flow openings 46 in the lid body 16, while the lid body 16 is still securely positioned relative to the container body 12.

As discussed above and as shown in FIG. 5C, the upper gasket 36 is configured to provide a sealed sliding friction fit between the lid body 16 and the inner wall 54 of the container body 12 so that when the lid body 16 is mated to the container body 12, the one or more fins 65 of the upper gasket 36 press against the inner wall 54 of the container body and prevent liquid from flowing out of the beverage container past the upper gasket 36. The upper gasket 36 may maintain its location on the lid body by spring force resulting from the gasket being stretched while seated in the recessed groove and/or an interference fit with the recessed groove. However, the disclosure of the above embodiment should not be read to limit the shape or configuration of the upper gasket (or lower gasket) to a rubber ring seated in a recessed groove and having one or more fins 65 projecting therefrom. Rather, additional configurations of recessed grooves and gaskets can be used to achieve the same purpose without departing from the scope of the present disclosure. Furthermore, in alternate embodiments, the upper or lower gaskets may be bonded to the lid body within a recessed groove, or bonded to a portion of the outer surface of the lid body without the need for a recessed groove, depending on the configuration, size, and shape of the gasket and, in the case of the upper gasket, the desired amount of sliding friction and degree of fluid-tight seal that is desired. The upper and lower gaskets may be made of rubber, silicone rubber, or any other polymer that will achieve the purpose and functionality of providing a seal and friction fit between the lid body and container body.

Referring to FIGS. 4A-6B, the plurality of fluid flow openings 46 are disposed in the lid body 16 between the location of the lower gasket 38 and the location of the upper gasket 36. As disclosed previously, the fluid flow openings 46 are openings in the lid body 16 through which the beverage or other fluid is permitted to exit the interior of the beverage container system 10 when the lid body 16 is engaged with the container body 12 and placed in an open position. The fluid flow openings are formed by the bottom 84 of the lid being separated from the sidewalls 82 of the lid. Other arrangements may be provided instead, such as one or more openings in the lid, either at a single location near the periphery of the lid or at multiple locations. A series of openings in an arrangement about the lid are possible.

Figure 6A:
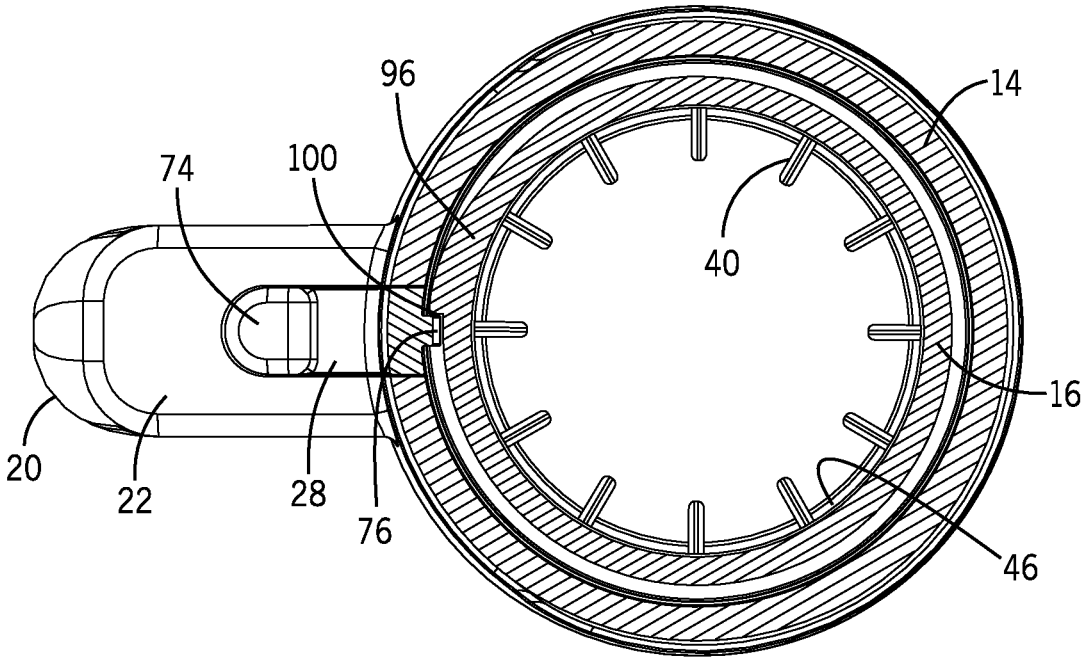
FIG. 6A is a top down cross-section view of an embodiment of the beverage container system taken about section line C-C in FIG. 4A, showing the locking tab of the lid release button engaged with the locking cam interference face of the lid body, thereby preventing unintentional removal of the lid from the beverage container system.
Figure 6B:
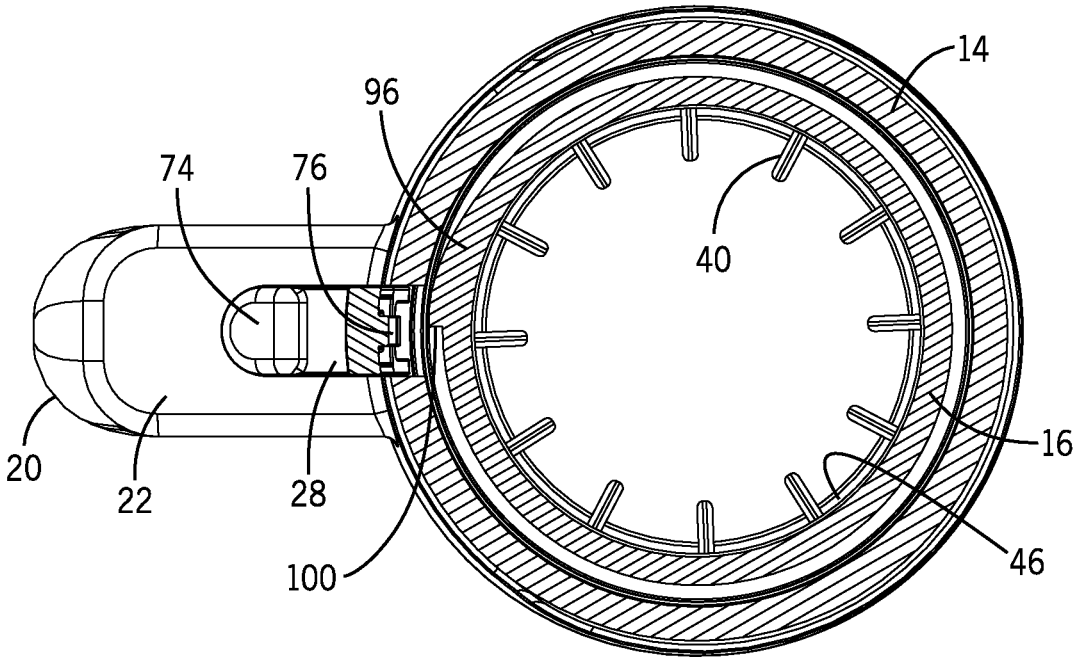
FIG. 6B is a top down cross-section view of an embodiment of the beverage container system taken about section line C-C in FIG. 4A, showing the locking tab of the lid release button disengaged from the locking cam in an unlocked position to permit removal of the lid body from the container body.
Figure 7A:
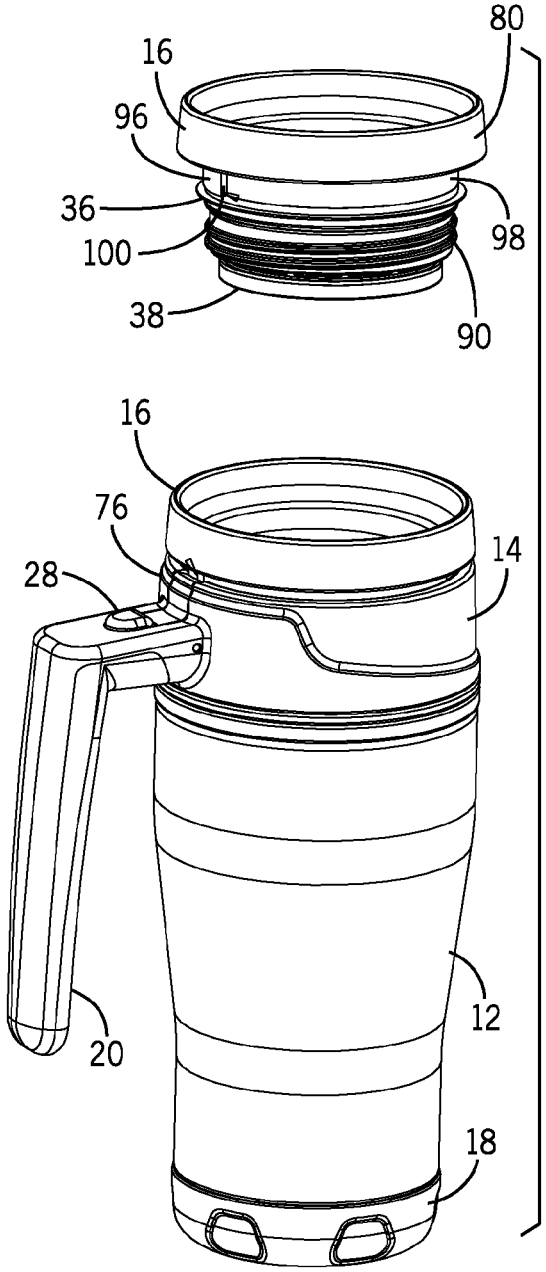
FIG. 7A is a perspective view of an embodiment of the beverage container system showing the lid body removed from the beverage container system of FIG. 1.
Figure 7B:
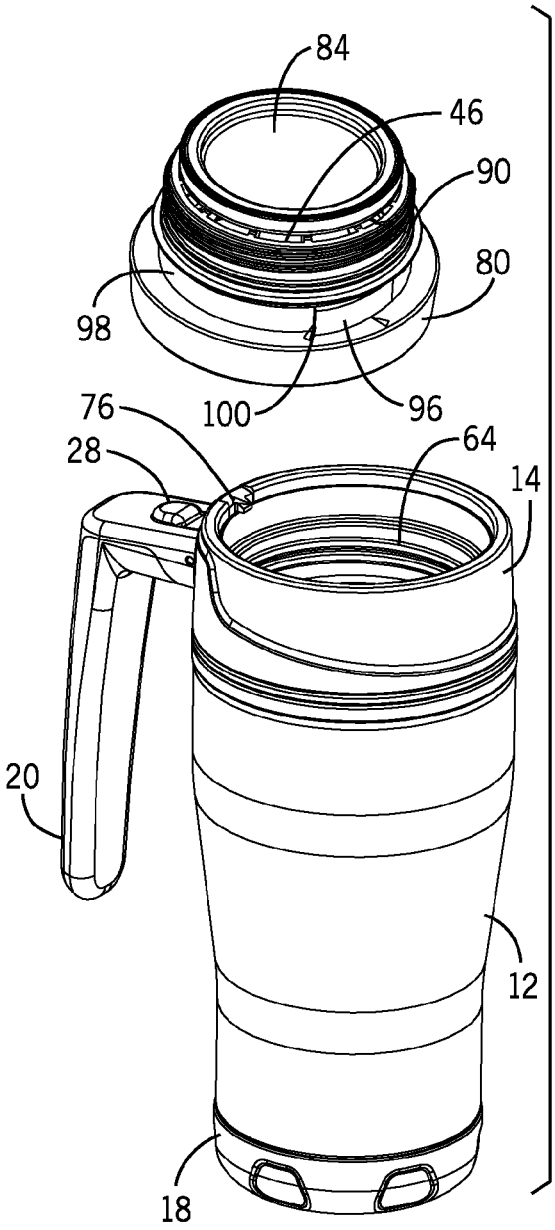
FIG. 7B is a perspective view of an embodiment of the beverage container showing the lid body removed from the beverage container system of FIG. 1, with the lid body being flipped upside down relative to its insertion orientation with the beverage container system, so as to show the locking cam, cam surface, the cam interference stop-face, and the fluid flow openings.

Referring to FIGS. 6A-7, the lid body 16 also has one or more locking cams 96 protruding horizontally from an exterior surface 98 of the cylindrical lid body 16 for engaging with the locking tab 76 of the lid release button 28 in the handle body 14. The cams 96 and locking tab 76 prevent the inadvertent movement of the lid beyond the liquid dispensing position that may risk the lid falling from the container during dispensing or drinking. In certain embodiments, the locking cam 96 is disposed above both the lower and upper gaskets 38 and 36, as well as above the thread structures 90 on the lid body 16. However, in alternate embodiments, the locking cam may be positioned elsewhere as needed to compliment alternate designs or positioning of the lid release button and associated locking tab. The locking cam 96 is essentially a horizontally arranged ramp that intersects the otherwise cylindrical outer surface 98 of the lid body 16 at a first end. The cam surface of the locking cam 96 protrudes radially outward from the cylindrical outer surface 98 of the lid body 16 from the first end of the cam to the second end of the cam, forming a ramp extending radially outward from the cylindrical surface 98. The locking cam 96 also has a cliff edge 100 that defines an interference stop-face at its second end for creating an interference fit with the locking tab 76 of the lid release button 28 to prevent movement beyond the liquid dispensing position, as will be explained further below.

Referring to FIGS. 4A and 5A, the beverage container system 10 is shown in a side cross section view to illustrate how the lid release button 28, lid body 16, and container body 12 function together. To use the assembled beverage container 10 and lid body 16, the lid body 16 is removed from the container body 12, and the container body 12 is filled, through the mouth of the container body 12, with a liquid beverage. The lid body 16 is inserted, bottom side first, through the mouth of the container body 12 and into neck 64 of the container body 16. The thread structures 90 in/on the outer surface of the lid body 16 are configured to engage with the thread structures in/on the neck 64 of the container body 12 so that they can engage each other. The lid body 16 is rotated about its axial center and the lid body 16 is screwed into the neck 64 of the container body 12.

Referring to FIG. 5A, as the lid body 16 is rotated and screwed into the container body 12, the upper gasket 36 begins to slidably and sealingly engage with the sidewall of the inner shell 54 of the container body 12 at the neck. Once the upper gasket 36 enters the mouth of the container body 12 and engages the sidewall of the inner shell 54 of the container body 54, the upper gasket 36 forms a liquid tight seal against the neck of the container body 12, even while it is rotating or otherwise sliding further into the neck 64 of the container body 12. As the lid body 16 is screwed further downward relative to the neck 64 of the container body 12, the upper gasket 36 also slides further in the same downward direction, entering further into the neck 54 and away from the mouth of the container body 12.

In addition, shortly after the thread structures 90 of the lid body 16 engage with the complimentary thread structures in/on the neck 64 of the container body 12, the locking cam 96 begins to engage the locking tab 76 of the lid release button 28 in the handle body 14. As the lid body 16 is screwed into the neck 64, the locking tab 76 of the lid release button 28, which is biased to a forward position and otherwise protrudes forward past the inner surface of the container body 12, engages with the locking cam 96 on the outer surface 98 of the lid body 16 as the cam rotatably slides past the locking tab 76. When the cam 96 passes by the locking tab 76 on the lid release button 28, the locking tab 76 acts as a cam follower that rides up the ramped cam surface from the first end of the cam as the lid body 16 is screwed into the container body 12. As the locking cam 96 engages the locking tab 76, the cam 96 pushes the locking tab 76 radially outward and away from the container body 12 and otherwise pivots the entire lid release button 28 about its hinge pin 30. The compression spring 32 below the push button 74 is compressed when the cam 96 passes by the locking tab 76 and the spring 32 applies a force in the opposite direction against the underside of the push button 74 of the lid release button 28 to keep the locking tab 76 in contact with the cam 96 as it passes by. The ramp shaped cam 96, of which there may be one or several about the circumference, automatically engages and moves the locking tab to a position for locking the lid in a retained lid position.

When the lid body 16 is rotated so that the locking cam 96 slidably passes by the locking tab 76, the locking tab 76 will deflect away from the axial center of the lid body 16 and ride up the cam surface until it reaches the second end of the cam 96 at the location of the cliff edge 100 of the cam. When the lid body 16 assembly is rotated further, the cam 96 passes completely by the locking tab 76, and the locking tab 76 and button 74 are forced by the compression spring 32 to reengage the cylindrical outer surface 98 of the lid body 16. The lid is now locked to prevent inadvertent unscrewing of the lid beyond the liquid dispensing position.

Referring to FIG. 6A, if the user were to now try to unscrew the lid body 16, whether intentionally or unintentionally, a side face of the locking tab 76 would make face-to-face interference contact with stop-face of the cam cliff edge 100 of the cam and prevent the lid body 16 from being unscrewed while the locking tab 76 is in the locking position. The locking tab 76 can be moved to an unlocked position, as will be described.

FIGS. 4A and 6A show the lid release button 28 in a locking position, wherein the locking tab 76 is engaged with the lid body 16 will prevent removal of the lid body 16 from the container body 12 and will prevent the lid body 16 from being moved to a position where it may separate from the container body 12. Referring to FIGS. 5A and 5B, if the lid body 16 has not been screwed all the way onto the container body 12, the lower gasket 38 will not be compressed against the sealing ridge 66 and fluid may flow past the lower gasket 38. The lid body 16 is thus in an open and locked position, whereby a user may sip or pour liquid from the beverage container system 10 without the lid falling off or fluid exiting the beverage container system anywhere other than through the fluid flow openings 46 in the lid body. The lid may also reach the illustrated position by being in a sealed, closed position and being moved to an open, beverage dispensing position. The interaction between the locking cam 96 on the lid body 16 and the locking tab 76 on the lid release button 28 provides a positive stop for the lid assembly when it is in an open position, to assure that the lid is on sufficiently and to assure the user that the lid body 16 is secured for drinking or dispensing fluid without the lid coming off. The user may continue to screw the lid body 16 onto the container body so that the lower gasket 38 is compressed so that the lid is in the closed, sealed position.

Referring to FIGS. 5A and 6B, to unscrew the lid body 16 for removal, the user must first depress the push button 74 of the lid release button 28 such as with a thumb or finger of one hand, which will pivot the locking tab 76 away from, and out of engagement with, the one or more locking cams 96 disposed on the lid body 16. With the push button 74 depressed and the locking tab 76 being maintained in the disengaged position, the user can then completely unscrew the lid body 16 from the container body 12 with the other hand and completely remove the lid body 16 from the container body 12. In this manner, the lid body 16 requires two hands to completely remove the lid body 16 from the container body 12.

Referring to FIG. 6A, the lid body 16 is thus placed in a locked condition by screwing the lid body 16 past the cliff edge 100 of the locking cam 96 such that the lid body 16 cannot be removed without first depressing the lid release button 74 to disengage the locking tab 76 from the lid body 16 and the one or more cams 96. Conversely, referring to FIG. 6B, the lid body 16 is placed in an unlocked condition when the locking tab 76 is disengaged from both the lid body 16 and the one or more locking cams 96 by depressing the lid release button 74. The lid release button 28 need only be pressed momentarily when the lid body 16 is unscrewed to clear the locking tab 76 from the cliff edge of the locking cam 96. Once cleared of the cliff edge 100, the lid release button 28 need no longer be pressed, as the locking tab 76 will merely slide on the ramped cam 96 or move over the exterior surface 98 with further unscrewing movement of the lid. One, two, three, or more locking cams may be provided on the lid body 16.

As discussed previously, if the user screws the lid body 16 completely into the container body 12, the lower gasket 38 will make contact with the face of the sealing ridge 66 and become compressed between the sealing ridge 66 and lid body 16, thus creating a fluid tight seal and placing the lid body 16 in a closed position. To access the fluid inside the container body 12, the user may partially unscrew the lid body 16 from the container body 12 to move the lower gasket 38 away from the sealing surface, thereby opening a fluid flow passage from the container. The user may unscrew the lid further up to the position at which a side face of the locking tab 76 makes contact with the stop-face 100 of the locking cam 96 on the lid body 16. This results in the lower gasket 38 in the lid body 16 pulling away from the sealing ridge 66 on the container body 12 for liquid dispensing. The user may drink from the beverage container system 10 or pour liquid from the container without further removal of the lid and without having to depress the lid release button 74. This position permits drinking of the beverage without splashing and with reduced chance of spilling, such as while commuting or traveling. The gap between the sealing ridge 66 and the lower gasket 38 is sufficient to permit the fluid within the container body 12 to pass by the lower gasket 38 and exit the beverage container through the fluid flow openings 46 in the lid body 16. The upper gasket 36 is still sealingly mated between the lid body 16 and an upper portion of the neck 64 to prevent the fluid from exiting the beverage container at any location other than the fluid flow openings 46.

As stated previously, to remove the lid body 16 for filling or cleaning the container body 12, the user depresses push button 74 of the lid release button 28 while unscrewing the lid, which disengages the locking tab 76 from the cliff edge of the one or more cams 96 on the lid body 16, and the lid body 16 may be completely unscrewed and removed from the container body 12.

Although the lid of the illustrated embodiment is engaged onto the container by thread and moved between the sealed and liquid dispensing positions by unscrewing the threaded parts, it is envisioned that a lid within the scope of the present invention may be moved between the sealed and dispensing positions by sliding movement, by translational movement, by rotational movement, by a bayonet movement, or otherwise. The person of skill in the art will understand how to apply a latch that prevents the lid from moving beyond the dispensing position unless the latch is released by the user.

While the disclosure herein has primarily been directed to a horizontally positioned cam protruding from the lid body, this should not be read as to limit the cam to being only horizontally positioned. In alternative embodiments, for example in an embodiment in which the lid is mated to the container body by simply pushing the lid body into the neck of the bottle, the cam on the lid body can be positioned vertically, or in any other direction as needed to fit a particular configuration for mating the lid body to the container body.

It is envisioned that the lid release button may be provided on either the beverage container or on the lid. A locking cam on the corresponding other part prevents inadvertent removal of the lid from the container.

Accordingly, a beverage container with a latch to manage lid position has been disclosed. Such a beverage container will prevent the lid from accidentally or inadvertently falling off when liquid is dispensed from the beverage container.

Although other modifications and changes may be suggested by those skilled in the art, it is the intention of the inventors to embody within the patent warranted hereon all changes and modifications as reasonably and properly come within the scope of their contribution to the art.

What is claimed is:

1. A beverage container system, comprising:

a container body having an open container mouth, a container sidewall, and a closed container bottom;

a lid release button operatively connected to said container body and having a first end and a second end, the lid release button having a push button disposed near said first end and a locking tab disposed near said second end, the lid release button being selectively positionable in a locking position or an unlocking position; and a lid assembly selectively removable from said mouth of said container body, said lid assembly having a lid body with one or more locking cams protruding from an outer surface of said lid body, wherein when said lid assembly is mated to said mouth of said container body and said lid release button is placed in a locking position, said locking tab engages said locking cam and places said lid assembly in a locked condition to prevent said lid assembly from being entirely removed from said mouth of said container body, thereby permitting a user to easily manage position of said lid assembly relative to said container body.

2. A beverage container system, comprising:

a container body having a container bottom, at least one container sidewall, and a container mouth, the container mouth including a lid engaging portion and the at least one container sidewall including a cylindrical interior wall;

a lid body defining at least one fluid flow opening and the lid body affixable to the container body at the container mouth, the lid body being selectively positionable in at least three positions relative to the container body, wherein a first of the three positions is a closed position, a second of the three positions is an open position, and a third of the three positions is a removed position in which the lid body is not in contact with the container body;

a first set of sealing surfaces between the container body and the lid body, wherein, in a first position, the first set of sealing surfaces being disposed for sealing engagement to provide a generally liquid tight seal so as to minimize egress of liquid from the beverage container system and wherein, in a second position, the first set of sealing surfaces being disposed to move from the sealing engagement to permit liquid egress from the beverage container system from between the sealing surfaces of the first set of sealing surfaces, thereby dispensing liquid through the fluid flow opening;

a second set of sealing surfaces between the container body and the lid body, the second set of sealing surfaces being disposed for sealing engagement when the lid is in the first position and the second position, the second set of sealing surfaces including the cylindrical interior wall of the container mouth as a complementary sealing surface of the second set of sealing surfaces;

a lid release button including a locking tab extending between the lid and the container body, the lid release button being selectively movable between a locking position and an unlocked position by a user; and a cam engaged by the locking tab when the lid is in the second position to prevent removal of the lid from the container body unless the lid release button has been moved to the release position by the user.

3. A beverage container as claimed in claim 2, wherein the lid release button is mounted on the container body and the cam is on the lid.

4. A beverage container as claimed in claim 2, wherein the lid release button includes a pivotably mounted latch structure having a push button and a locking tab.

5. A beverage container as claimed in claim 2, wherein the cam includes a ramp-shaped portion having a cliff edge for engagement with the lid release button.

6. A beverage container as claimed in claim 5, wherein the lid body includes a cylindrical surface, the ramp-shaped portion extending radially from the cylindrical surface.

7. A beverage container as claimed in claim 6, wherein the lid release button includes a locking tab that engages the ramp-shaped portion during attachment of the lid body to the container body, wherein the locking tab is disengaged from the ramp-shaped portion when the lid body is in the sealed position.

8. A beverage container as claimed in claim 2, wherein the container body includes a container portion and a handle portion, the lid release button being mounted in the handle portion.

9. A beverage container as claimed in claim 8, wherein the handle portion includes a collar mounted on the container portion, the collar defining a mouth portion of the container body wherein the lid is mounted in the mouth portion of the container body, the handle portion including a grip extending from the collar, the user operable latch including a user button mounted in the grip.

10. A beverage container as claimed in claim 9, wherein the user operable latch includes a first end with the user button and a second end with the locking tab, and further comprising: a spring mounted between the user operable latch and the handle portion.

11. A beverage container as claimed in claim 2, wherein the container body is a drinking mug and wherein the lid body is affixed to the drinking mug, the lid body including a lid sidewall affixed to the drinking mug, a bottom portion separated from the lid sidewall by a fluid flow opening; and radial ribs connecting the bottom portion to the lid sidewall, the fluid flow opening permitting fluid within the drinking mug to be dispensed from the drinking mug through the fluid flow opening when the lid body is in the liquid dispensing position.

12. A beverage container as claimed in claim 11, wherein the fluid flow opening extends about the entire circumference of the bottom portion so that a user may drink from the drinking mug from any position around the circumference of the lid body.

* * * * *